US007174576B1

(12) United States Patent
Tedrick

(10) Patent No.: US 7,174,576 B1
(45) Date of Patent: Feb. 13, 2007

(54) SPA COVER WITH INTERNAL REINFORCEMENT

(76) Inventor: John Tedrick, 4937 S. 86th E. Ave., Tulsa, OK (US) 74145

( * ) Notice: Subject to any disclaimer, the term of this patent is extended or adjusted under 35 U.S.C. 154(b) by 0 days.

(21) Appl. No.: 11/208,173

(22) Filed: Aug. 22, 2005

(51) Int. Cl.
*E04H 4/06* (2006.01)

(52) U.S. Cl. ..... 4/498; 52/800.12; 428/71

(58) Field of Classification Search ..... 4/498, 4/580; 52/800.12, 800.18; 264/46.7; 428/71
See application file for complete search history.

(56) References Cited

U.S. PATENT DOCUMENTS 4,078,293 A * 3/1978 Aine ..... 4/498 X
4,422,192 A * 12/1983 Jacobs ..... 4/498
5,853,512 A * 12/1998 McKinney ..... 264/46.7 X

* cited by examiner

*Primary Examiner*—Robert M. Fetsuga

(57) ABSTRACT

Improvement in spa cover design to increase the weight carrying capacity of the cover by using internal reinforcements.

3 Claims, 2 Drawing Sheets

SPA COVER WITH INTERNAL REINFORCEMENT

BACKGROUND OF THE INVENTION

1. Field of the Invention

This invention relates to the design and construction of spa covers and the reinforcement thereof. The use of spas has become widespread, and most spas are equipped with covers which when closed prevents debris, rain and the like from contaminating the tub water. The cover further serves to retain heat within the tub.

To facilitate customer handling and storage the cover is made in two sections, half and half, and joined by a flexible flap, thus each half can be reinforced separately.

Some spa owners have expressed an interest in reinforced covers for various reasons. Spa owners who live in cold climates would like a stronger cover to support the heavy snow pack. Some spa owners want a stronger cover to prevent a collapse if an uninvited guest should climb a top of the spa cover.

Many types of spa covers have been designed and manufactured in recent years. Also, many more large spas are now being sold, which require larger covers. This has resulted in problems with covers sagging in the middle after a few years use.

Many owners have bought cover lifters to help raise and remove the spa covers. Thus, adding a few pounds of reinforcement to the cover would not be a burden to the lifter system, and would help keep the cover from sagging.

2. Description of Related Art

I have searched many patents under 4/498,580,584. I did not find any references to structural reinforcing members. The search included: Zell U.S. Pat. No. 6,886,187, Minnick U.S. Pat. No. 6,618,868, Bussey U.S. Pat. No. 6,385,791, Ziebert U.S. Pat. No. 6,112,340, Gray U.S. Pat. No. 6,374,433, Brown U.S. Pat. No. 6,047,415, Pucci U.S. Pat. No. 5,974,600, Pesterfield U.S. Pat. No. 5,783,019, Aragona U.S. Pat. No. 4,246,663, Wendt U.S. Pat. No. 4,236,259.

DESCRIPTION OF THE INVENTION

A new design of a spa cover, Variation I, is illustrated in FIGS. 1 and 3. We start with a foam core (41) and cut to size for an individual spa. Next we make the end cap (43), using sheet metal we cut to length and break each edge to form a channel with flanges. Then we select the size of a cover half reinforcing member (42) we need and cut to length. We then use a router to cut parallel grooves (44) in the bottom face of the foam core to accept the reinforcing members (42). We then assemble the above parts and slip the flexible cover (46) over the assembly to hold everything in place. In FIG. 2, the flexible cover (46) has been removed.

In variation II of this design illustrated in FIG. 4, we bore holes (45) through the width of the foam core and insert the reinforcing members (42).

In variation III of this design we use reinforcing members (42') with a drop center (FIG: 6). The foam core is then routed only enough to accord fitting the reinforcing members (42') in place by forming aligned pairs of parallel grooves (44) on opposite sides of the foam core. The opposite ends of the reinforcing members (42') are then placed in the pairs of grooves. This also provides an opportunity to place additional cross brace reinforcing material such as rods, tubes, strips, plates of metal, plastic or other material between the foam core and the reinforcing members.

In all variations the cover half is placed on a spa (not shown) with the bottom flange of the end cap (43) extending across the center of the spa and with the reinforcing members (42,42') resting on the wall of the spa.

DESCRIPTION OF THE DRAWINGS

FIG. (1) is a side view of the spa cover showing a cross section taken through one reinforcing member.

FIG. (2) is a top view of the spa cover showing layout of the grooves.

Figure 1:
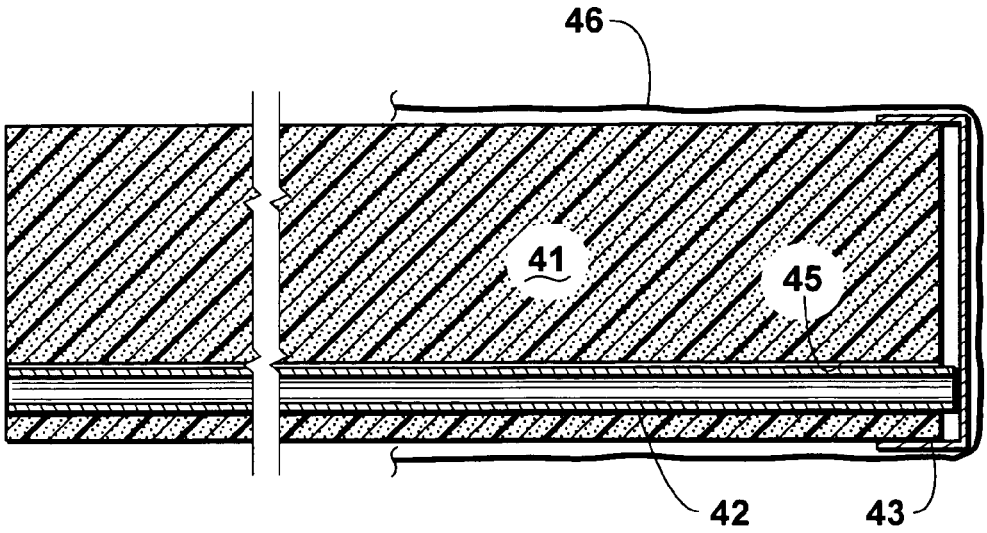
Figure 2:
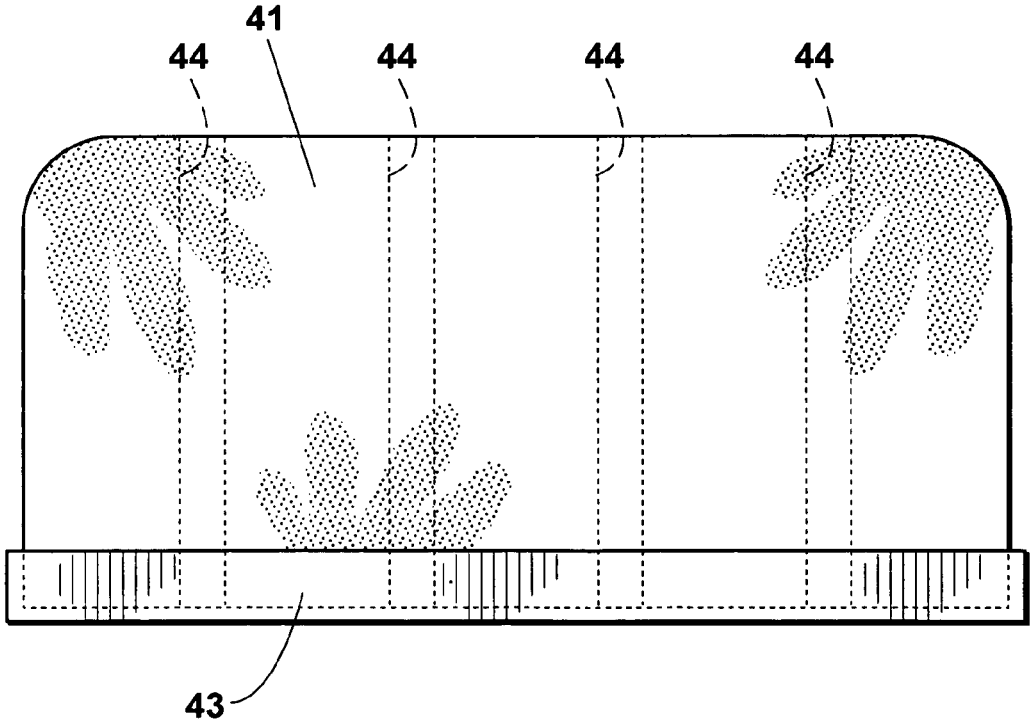
Figure 3:
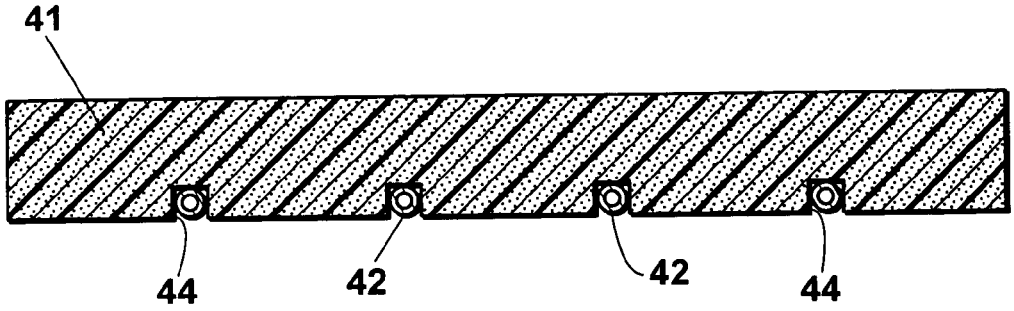
Figure 4:
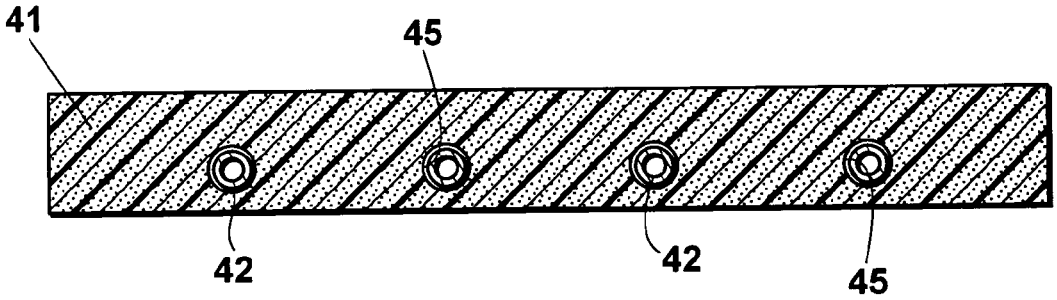
Figure 5:
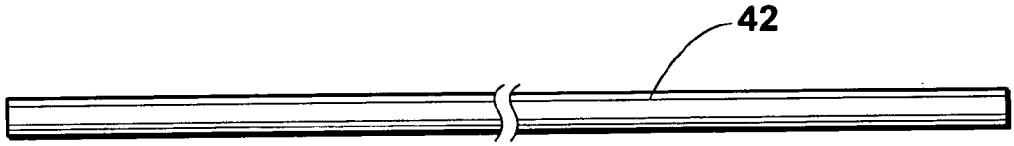
Figure 6:
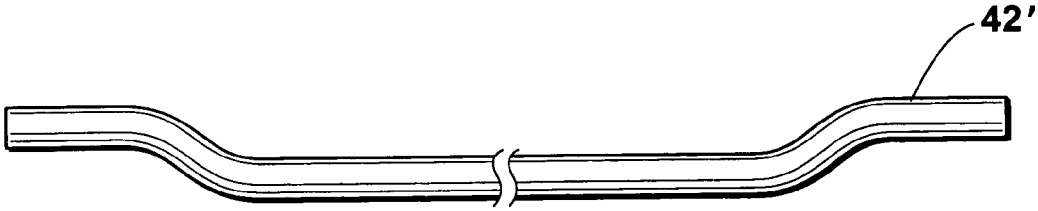

FIG. (3) is a cross section of the spa cover showing reinforcing members installed in the grooves.

FIG. (4) is a cross section of the spa cover showing the reinforcing members installed in the drilled holes.

FIG. (5) is a side view of the straight reinforcing member.

FIG. (6) is a side view of the drop center reinforcing member.

The invention claimed is:

1. A reinforced cover half for a spa tub comprising: a foam core; parallel grooves in a bottom face of said foam core; reinforcing members aligned in said grooves; and an end cap over an end face of said foam core; said foam core, end cap and reinforcing members being encased in a flexible material cover; said foam core and said reinforcing members being sized to extend from one wall of the spa tub to the center of the spa tub with said reinforcing members resting at one end on the wall of the spa tub and at another end on a bottom flange of said end cap.

2. A reinforced cover half for a spa tub comprising: a foam core; parallel holes through a width of said foam core; reinforcing members disposed in said holes; and an end cap over an end face of said foam core; said foam core, end cap and reinforcing members being encased in a flexible material cover; said foam core and said reinforcing members being sized to extend from one wall of the spa tub to the center of the spa tub with said reinforcing members resting at one end on the wall of the spa tub and at another end on a bottom flange of said end cap.

3. A reinforced cover half for a spa tub comprising: a foam core; aligned pairs of parallel grooves in opposite sides of a bottom face of said foam core; drop center reinforcing members having opposite ends disposed in opposite grooves; and an end cap over an end face of said foam core; said foam core, end cap and reinforcing members being encased in a flexible material cover; said foam core and said reinforcing members being sized to extend from one wall of the spa tub to the center of the spa tub with said reinforcing members resting at one said opposite end on the wall of the spa tub and at another said opposite end on a bottom flange of said end cap.

* * * * *